US005988489A

United States Patent [19]

Moteki et al.

[11] Patent Number: 5,988,489

[45] Date of Patent: Nov. 23, 1999

[54] PACKAGE, CARTON PACKAGE AND CARTON TAPE

[75] Inventors: Yoshiji Moteki, Kitaadachi-gun; Shigeyuki Ohshima, Nakano-ku, both of Japan

[73] Assignee: Hosokawa Yoko Co., Ltd., Japan

[21] Appl. No.: 09/097,824

[22] Filed: Jun. 16, 1998

[30] Foreign Application Priority Data

Jun. 21, 1996 [JP] Japan ..... 8-161918
Jun. 19, 1997 [JP] Japan ..... 9-162706

[51] Int. Cl.[6] ..... B65D 5/62; B65D 65/28

[52] U.S. Cl. ..... 229/87.05; 229/87.07; 229/87.13; 229/87.18; 229/203; 229/926

[58] Field of Search ..... 229/87.05, 87.07, 229/87.13, 87.18, 87.19, 116.5, 203, 923, 924, 926; 206/264

[56] References Cited

U.S. PATENT DOCUMENTS 2,197,219 4/1940 Groshong ..... 229/87.05
2,330,691 9/1943 Darrow ..... 229/203
4,522,887 6/1985 Koebisu et al. ..... 229/87.07
4,726,473 2/1988 Sato et al. ..... 229/87.05
5,560,538 10/1996 Sato et al. ..... 229/87.05
5,645,211 7/1997 Shimada ..... 229/87.05

*Primary Examiner*—Gary E. Elkins
*Attorney, Agent, or Firm*—Parkhurst & Wendel, L.L.P.

[57] ABSTRACT

A package is composed of an inner box accommodating an inner content and an outer packing member essentially formed of a plastic film layer and adapted to wrap the inner box so as to have end portions to be bonded in a projecting manner through a heat sealing process. A pair of notches are formed to an end edge portion of the bonded end portions of the outer packing member and the packing member is provided with an easily opening portion at a portion near a base portion of one of the projected bonded end portions so as to correspond to the paired notches. In another aspect, a carton package comprises a carton body having an opened end, a pair of lid pieces formed integrally with the carton body and a carton tape applied to mating end edge portions of the lid pieces when closed, the carton tape having a tearing portion, from which the carton tape is easily torn, formed so as to extend in a longitudinal direction of the carton tape at a central portion in a width direction thereof.

6 Claims, 3 Drawing Sheets

PACKAGE, CARTON PACKAGE AND CARTON TAPE

BACKGROUND OF THE INVENTION

The present invention relates to easily openable packages each in the shape of a box, and more particularly, packages each comprising an inner box or case and an outer plastic film packing an outer periphery of the inner box and containing an inner content which is easily taken out by opening the plastic film along the outer periphery thereof, and the present invention also relates to a carton tape which is easily torn at its intermediate portion in a width direction thereof without using any cutting device and relates to a carton package using such carton tape.

For example, foods such as chewing gum, sweet jelly beans or the like have been commercially sold in a package in which the food is accommodated in an inner box such as paper and packed or wrapped by an outer packing film formed of such as plastic film. However, a outer packing film is generally formed of the plastic film which cannot be easily torn, and hence, it is difficult for a user to take out the inner content contained in the inner box by easily tearing the outer packing film of the package.

For example, in one aspect, for a package of cigarettes or cigars, in order to easily tear or break an outer packing of the package, a plastic film forming the outer packing is composed of two plastic films and a tear(tearable) tape disposed between these plastic films, and the outer packing is opened by tearing the outer packing along the tear tape.

As mentioned above, the package provided with such tear tape is openable by tearing the outer packing along the tear tape to take out the inner content accommodated in the inner box. However, it is required for the outer packing to have two plastic films having both-surface heat sealable structure to interpose the tear tape therebetween, that is, the outer packing is required to have at least three-layer structure of the plastic films. In addition, positioning of the tear tape is troublesome process. Thus, the plastic film manufacturing process is made complicated, which will increase the manufacturing cost of the package.

The box-shaped package will further include a carton package in another aspect. The carton package is generally composed of a carton body formed by bending or folding a carton so as to provide a box-shaped carton body having an opening which is covered by a pair of lid members integrally formed with the carton body. The lid members entirely cover the opening of the carton body by bending at both side edge portions of the opening so that front end edge portions thereof are mated when bent. When both end edge portions of the lid members are mated at a closed position on the carton body, they are tied to each other by means of a carton tape, thereby fastening the lid members to the closed position. The opening of such carton package is performed by opening the lid members, and when the lid members are opened, it is required to tear the carton tape stuck to the mated end edge portions of the lid members or peel off the carton tape from the lid members.

The carton tape is generally composed of a tape body formed of a paper or synthetic resin film, a binder layer on one surface of a tape body and a release agent layer on the other one surface thereof. The carton tape is wound up around a core member and is cut into a piece having a predetermined width when used. Such carton tapes have relatively large tearing (i.e. rupture) strength, which differ from each other due to the difference of the tape materials, and hence, the carton tapes have structure not to be easily torn or cut.

The tearing strength of the carton tape is determined by the tension strength of the tape material itself, and accordingly, when the tension strength is made small for easily tearing the carton tape, it is impossible to sufficiently function as the carton tape, and on the contrary, when the tension strength thereof is made strong for eliminating such defect, it will be required to use a certain cutting means for cutting the carton tape.

SUMMARY OF THE INVENTION

The present invention was conceived to eliminate defects or drawbacks encountered in the prior art mentioned above, and a first object according to a first aspect of the present invention is to provide a package having a simple structure and composed of an inner case in which an inner content is accommodated and an outer packing plastic film which can be easily opened along an entire outer periphery of the inner box to take out the inner content.

A second object according to a second aspect of the present invention is to provide a carton tape which can be easily torn at its intermediate portion in the width direction thereof without using any cutting means and also to provide a carton package using the carton tape of the character mentioned above to easily take out the inner content.

These and other objects can be achieved according to the present invention, in one aspect, by providing a package composed of an inner box accommodating an inner content and an outer packing member essentially formed of a plastic film layer and adapted to pack or wrap the inner box so as to have end portions to be bonded in a projecting manner through a heat sealing process, wherein a pair of notches are formed to an end edge portion of the bonded end portions of the outer packing member and the packing member is provided with an opening portion, from which the packing member starts to be easily opened, at a portion near a base portion of one of the projected bonded end portions so as to correspond in position to the paired notches.

In a preferred example of this aspect, the outer packing member is a laminate film having at least one plastic film layer and the opening portion is composed of a score line formed to at least one of the plastic film layers so as to extend in parallel to the bonded end portions in a longitudinal direction thereof. In an alternation, the opening portion may be composed of a coarse surface portion formed to at least one of the plastic film layers so as to extend in parallel to the bonded end portions in a longitudinal direction thereof. The coarse surface portion will be formed by pressing sandpaper to the plastic film constituting the outer packing member.

A preferable one of the outer packing members is composed of a laminate film having an oriented plastic film layer and an opening portion from which the packing member is easily opened formed to at least the oriented plastic film layer.

According to this first aspect of the present invention mentioned above, a pull-out portion is formed by a portion between the paired notches having a predetermined width, the pull-out portion constituting an opening starting portion, and when the pull-out portion is pulled, the opening portion formed to the packing member near the bonded end portions is torn. The outer packing member is then opened by tearing it along the entire outer periphery of the packing member by further pulling the pull-out portion, whereby the inner content can be taken out through the thus opened end of the package.

In the second aspect of the present invention, there is provided a carton package comprising a carton body having an opened end, a pair of lid pieces formed integrally with the carton body so as to cover the opened end thereof and a carton tape applied to mating end edge portions of the lid pieces when closed, the carton tape having a tearing portion, from which the carton tape is easily torn or opened, formed so as to extend in a longitudinal direction of the carton tape at a central portion in a width direction thereof.

In a preferred example of this aspect, the carton tape is composed of a carton tape body mainly formed of a biaxially oriented polypropylene film layer and a binder layer applied to one of surfaces of the carton tape body and the tearing portion is formed to the carton tape body.

The tearing portion of the carton tape may be composed of a plurality of parallel score lines formed at least to the biaxially oriented polypropylene film layer or formed of a coarse surface portion formed at least to the biaxially oriented polypropylene film layer. The coarse surface portion is formed by pressing sandpaper to a film layer constituting the carton tape body.

According to the carton package using the carton tape of the structures mentioned above, the carton package can be easily opened by tearing the carton tape along the tearing portion without using any cutting means or the like.

The nature and further characteristic features of the present invention will be made more clear from the following description made with reference to the accompanying drawings.

DESCRIPTION OF THE PREFERRED EMBODIMENTS

An embodiment according to one aspect of the present invention will be described hereunder with reference to FIGS. 1 to 3.

Figure 1:
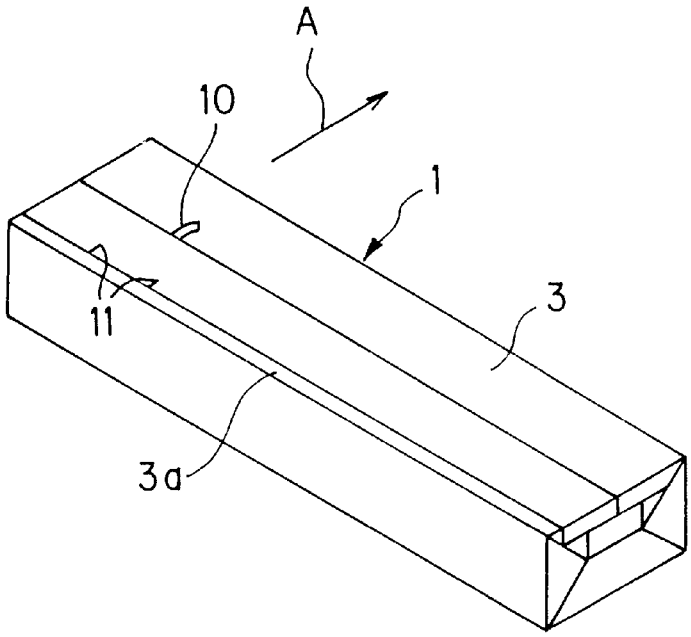
FIG. 1 is a perspective view of a package according to one aspect of the present invention.
Figure 2:
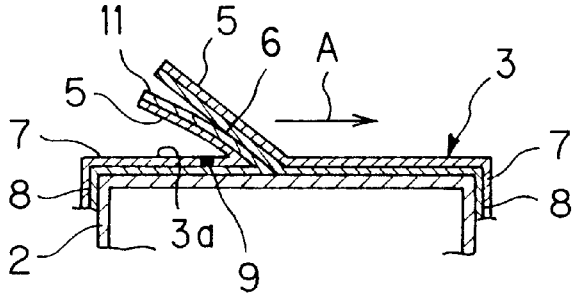
FIG. 2 is a partial sectional view, in an enlarged scale, of the package shown in FIG. 1.

FIGS. 1 and 2 represent an embodiment of a package according to one aspect of the present invention which is applied to a chewing gum package. The package 1 is composed of an inner box(case) 2 formed of a relatively thick paper so as to have a dimension capable of accommodating chewing gum therein and an outer packing (wrapping) member 3 for wrapping the inner box 2 in a sealing manner. The material and dimension of the inner box 2 may be changed as occasion demands in accordance with a content to be accommodated therein. For example, when the inner box 2 is formed as a case for accommodating cigarettes, the inner box 2 may be formed of a relatively thin paper.

Figure 3:
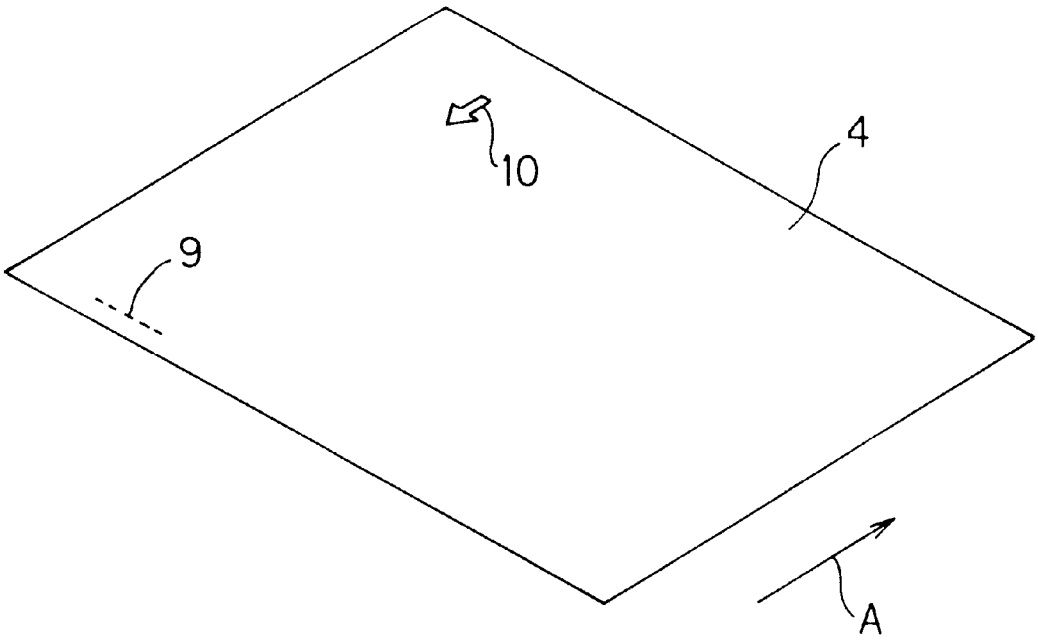
FIG. 3 is a developed view of an outer packing member of the package of FIG. 1.

The outer packing member 3 is formed by first preparing a material 4 for the outer packing member 3 cut in a rectangular shape so as to correspond to the dimension of the inner box 2, as shown in FIG. 3, bending and folding the material 4 along the outer shape of the inner box 2, bonding both the bent end portions 5, of the material 4 at heat-seal portion 6 so that the bonded end portions 5, project outward, as shown in FIG. 2, and heat sealing both opened ends by heat sealing means, such as known seal bar method, ultrasonic seal method, high frequency seal method or the like. The projecting bonded end portions 5, are then bent towards a packing member side 3*a* so as to contact the same.

In the embodiment shown in FIG. 2, as the outer packing material 4 is selected a laminate film formed by laminating a biaxially oriented polypropylene film 7 having a thickness of 20 $\mu$m which is provided with a polyvinylidene chloride coat and a polyethylene film 8 having a thickness of 15–30 $\mu$m. Such laminate film is used as the outer packing member 3, and the biaxially oriented polypropylene film constitutes an outer surface thereof. Since this laminate film is transparent, the outer packing member 3 is itself also transparent. When it is required to make opaque the outer packing member 3, there will be used a laminate film as the outer packing material 4 formed, for example, by laminating a polyester film having a thickness of 12 $\mu$m, a polyethylene film having a thickness of 15 $\mu$m, an aluminum foil having a thickness of 7 $\mu$m and a polyethylene film having a thickness of 20 $\mu$m. In this case, the polyester film layer will constitutes an outer surface of the packing member when used.

The outer packing material 4 is formed with a score line 9 along one end side of the packing material 4, as shown in FIG. 3, at a portion corresponding to a body side 3*a* near the projecting bonded end portions 5, when the outer packing material 4 is bent along the outer shape of the inner box 2. The body side 3*a* is a portion of the packing member 3 other than the projected bonded end portions 5. The score line 9 extends in a direction normal to a direction A of the film along which it is torn. The score line 9 is formed to the biaxially oriented polypropylene film layer 7 positioned on the front surface side of the outer packing member 3, and an indication mark 10 or the like is formed, through printing process, on the back surface of the biaxially oriented polypropylene film 7 for facilitating easy opening of the packing member 3. Since this polypropylene film 7 has a transparency, the indication mark 10 can be seen from the outside of the package. The indication mark 10 is a mark showing a direction along which a pull-out piece, mentioned latter, is pulled and the mark 10 is located in association with the score line 9. That is, when the outer packing member 3 is formed from the packing material 4, the indication mark 10 is positioned near the score line 9 so as to indicate the film tearing direction A. The score line 9 has, for example, 5 mm, which is formed of cuts (notches) each having 1 mm and non-cut portions each having 0.5 mm, and these cuts and non-cut portions are alternately continuously formed so as to provide the score line 9.

A pair of notches 11, are formed with a predetermined distance at portions, corresponding to the score line 9, of the projected bonded end portions 5, of the outer packing member 3. The distance between the notches 11, is determined to be smaller than the length of the score line 9 so that both the end portions of the score line 9 extend over the width between the notches 11. When the packing member 3 is torn along the notches 11, the torn piece constitutes a pull-out piece for opening the outer packing member 3.

The functions and operations of the package according to one aspect of the present invention will be described hereunder.

The package 1 for chewing gum has projected bonded end portions 5, of the outer packing member 3 which are laid down in a state to be commercially sold, as shown in FIG. 1, so that the bonded end portions 5, contact the body side 3*a* of the packing member 3.

When a user wants to take out the inner content accommodated in the inner box 2 by tearing the outer packing member 3, the user takes the steps of raising upward the laid end portions 5, from a portion of the body side 3*a* of the packing member 3 near a base end portion of the rising bonded portions 5, and pulling the portion between the notches 11, formed to the bonded end portions 5, in the arrowed direction 10, by which this portion is torn as an opening starting portion from which the packing member 3 is opened to thereby form the pull-out piece having a predetermined width. When the user then pulls, with his fingers, the pull-out piece in the direction 10, the pull-out piece breaks the score line 9 formed to the body side 3*a* of the packing member 3 over the bonded portion 6 of the projected end portions 5. Thereafter, when the pull out piece is further pulled along the direction of the indication mark 10, the body side 3*a* of the packing member 3, i.e. a portion near the base portion of the projected bonded end portions, can be opened along the entire outer periphery thereof with the width corresponding to the width of the pull-out piece so that the outer packing member 3 is separated into two portions from the torn portion opened by the pull-out piece, and the one end portion of the packing member 3 is opened as an opened end through which the inner content, i.e. chewing gums, in the inner box 2 can be taken out.

In the embodiment of the package according to one aspect of the present invention mentioned above, although the score line 9 is formed as an opening portion of the body side 3*a* of the packing member 3, from which the packing member starts to be easily opened, hereafter called easily opening portion hereunder, in order to ensure an improved sealing performance, the easily opening portion may be formed, in a preferred example, with a coarse surface portion having a fine width by pressing sandpaper to the biaxially oriented polypropylene film 7 before lamination thereof. Further, the steps of forming the score line or coarse surface portion to the material film, effecting the printing working and laminating the films may be carried out substantially at the same time in single line through an inline process.

As described above, according to one aspect of the present invention, a pair of notches 11, are formed, with a distance, to the edge portion of the projected bonded end portions and the easily opening portion is formed to the body side of the packing member near the heat-seal portion of the bonded end portion so as to correspond to the formation of the paired notches 11, and the portion between these notches 11, is formed as the pull-out piece having a predetermined width from which the opening of the package starts. When the pull-out piece is further pulled, the pull-out pieces tears the easily opening portion formed to the body side near the bonded portion of the projected bonded end portions, and then, the entire outer periphery of the outer packing member can be opened by further pulling the pull-out piece, whereby the inner content accommodated in the inner box can be taken out.

The embodiment according to the second aspect of the present invention will be described hereunder with reference to FIGS. 4, 5 and 6.

Figure 4:
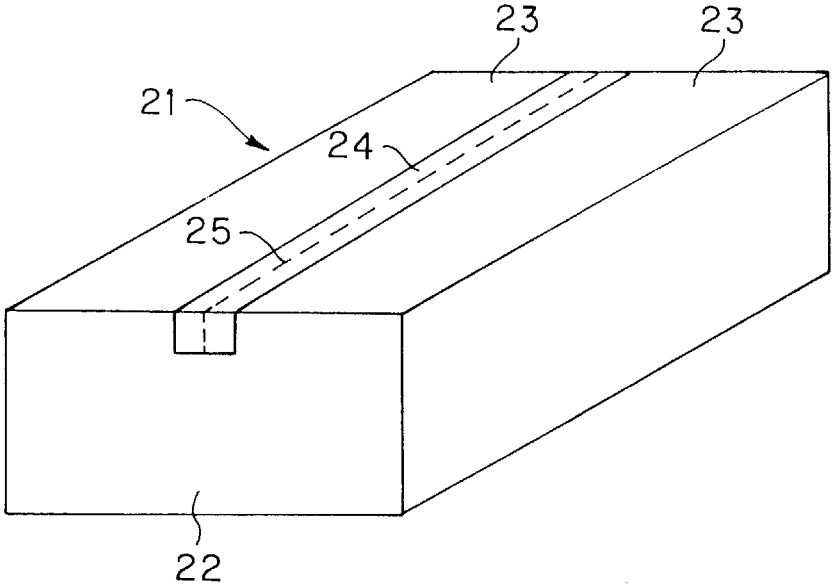
FIG. 4 is a perspective view of a carton package according to another aspect of the present invention.

FIG.4 is a perspective view showing entire outer appearance of a carton package 21, which is composed of a carton 22 formed of a corrugated board in a box-shape having an opening and a carton tape 24 applied to lid pieces 23, integrally formed with the carton 22 to cover the opening when closed, the carton tape 24 being applied so as to straddle, i.e. cross over, the closed lid pieces 23.

Figure 5:
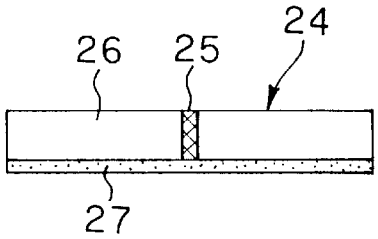
FIG. 5 is a cross sectional view of a carton tape according to the present invention to be used for the carton package of FIG. 4.

As shown in FIG. 5, the carton tape 24 is composed of a carton tape body 26 formed of a material of biaxially oriented polypropylene film having a thickness of 40 $\mu$m and provided with a tearing(opening) portion 25, from which the carton tape is easily torn or opened, hereafter called easily tearing portion hereunder, having a fine width and provided at a central portion in the width direction and a binder layer 27 applied to one surface of the carton tape body 26. Since such carton tape 24 is commercially sold in a rolled state, a releasing agent, not shown in the drawings, is applied to the other surface opposing to the surface on which the binder layer is formed.

The easily tearing portion 25 formed to the carton tape 24 has a width of about 4 mm in the case of the tape 24 having a width of 50 mm, for example, and is formed by five parallel score lines. In such case, each of the score lines comprises slits each having a length of 1 mm and connecting portions each having a length of 0.5 mm, these slits and connecting portions being alternately continuously formed so as to provide a score line, and in the adjacent two score lines, the slits of one score line are positioned in parallel to the connecting portions of the other score line.

Figure 6:
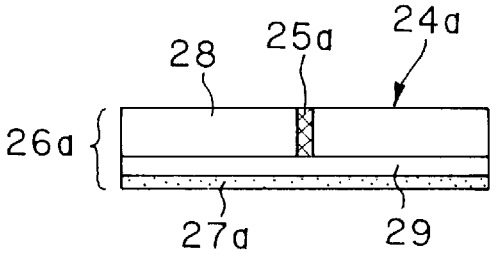
FIG. 6 is a cross sectional view of another carton tape according to the present invention.

FIG. 6 represents another embodiment of the carton tape of the second aspect of the present invention. The carton tape 24*a* of this embodiment is composed of a carton tape body 26*a* and a binder layer 27*a* applied to one surface of the carton tape body 26*a*. The carton tape body 26*a* is formed by laminating a biaxially oriented polypropylene film layer 28 having a thickness of 40 $\mu$m and provided with an easily tearing portion 25*a* having a fine width at a central portion in the width direction thereof and a non-oriented polypropylene film layer 29 having a thickness of 20 $\mu$m. In the present invention, a non-oriented plastic film layer may be laminated by an extrusion lamination process. In the case of the carton tape 26*a* composed of two polypropylene layers 28 and 29, the easily tearing portion 25*a* may be formed, in a preferred example, with a coarse surface portion by pressing sand paper rolled up around a roller having a fine width to the biaxially oriented polypropylene film 28 before the lamination of the non-oriented polypropylene film 29 thereto. Further, in this second aspect, the steps of forming the score line or coarse surface portion to the material film and laminating the films may be carried out substantially at the same time in a single line through an inline process.

The functions of this second aspect of the present invention will be described hereunder.

In the carton package 21, the carton tape 24 is applied so that the easily tearing portion 25 of the carton tape 24 is positioned between lid pieces 23, of the carton 22 to cover the mating portion thereof to thereby close the opening of the carton 22. In this state, since the easily tearing portion 25 is positioned along the end edges of the lid pieces 23, this portion will not be broken as far as a strong pressing force is applied to the lid pieces 23.

When it is required to open the carton package 21 thus closed, the easily tearing portion 25 is pressed downward with a strong force and then the carton tape 24 is torn into two portions at the easily tearing portion 25. The lid pieces 23, are then opened. This package opening operation can be done without using any cutting means.

According to the embodiments of the second aspect of the present invention mentioned above, the carton package can be easily opened without using any cutting means or the like.

What is claimed is:

1. A package comprised of an inner box accommodating an inner content and an outer packing member comprising a plastic film layer wrapping the inner box such that end portions which are partially bonded to each other project outwardly, wherein a pair of notches are formed in an edge portion of at least one of said end portions and an opening portion located near a base portion on a side of a pull-out piece formed by tearing the end portions between the pair of notches.

2. A package according to claim 1, wherein said outer packing member is a laminate film having at least one plastic film layer and said opening portion is comprised of a score line formed in at least one of said plastic film layers to extend parallel to the end portions in a longitudinal direction.

3. A package according to claim 1, wherein said outer packing member is a laminate film having at least one plastic film layer and said opening portion is comprised of a coarse surface portion formed in at least one of said plastic film layers to extend parallel to the bonded end portions in a longitudinal direction.

4. A package according to claim 3, wherein said coarse surface portion is formed by pressing sand paper to the plastic film constituting the outer packaging member.

5. A package according to claim 1, wherein said outer packing member is a laminate film having an oriented plastic film layer and an opening portion is formed in said oriented plastic film layer.

6. A package according to claim 1, wherein the distance between the pair of notches is less than the length of a score line located near the end portions and normal to said pair of notches.

* * * * *